US009538831B1

(12) United States Patent
Tracy

(10) Patent No.: US 9,538,831 B1
(45) Date of Patent: Jan. 10, 2017

(54) STAND FOR SUPPORTING WIGS

(71) Applicant: Theresa Tracy, Mt. Croghan, SC (US)

(72) Inventor: Theresa Tracy, Mt. Croghan, SC (US)

( * ) Notice: Subject to any disclaimer, the term of this patent is extended or adjusted under 35 U.S.C. 154(b) by 1 day.

(21) Appl. No.: 14/704,202

(22) Filed: May 5, 2015

(51) Int. Cl.

| | |
|---|---|
| ***A47F 5/02*** | (2006.01) |
| ***A47F 7/06*** | (2006.01) |
| ***A47G 25/10*** | (2006.01) |
| ***A47B 43/00*** | (2006.01) |
| ***A47B 47/00*** | (2006.01) |
| ***A47B 57/00*** | (2006.01) |
| ***A45D 44/14*** | (2006.01) |
| ***F16M 11/28*** | (2006.01) |
| ***F16M 11/08*** | (2006.01) |
| ***A47F 5/04*** | (2006.01) |
| ***A47B 46/00*** | (2006.01) |
| ***D06F 57/04*** | (2006.01) |

(52) U.S. Cl.
CPC ..... *A45D 44/14* (2013.01); *A47B 46/005* (2013.01); *A47F 5/02* (2013.01); *A47F 5/04* (2013.01); *A47F 7/06* (2013.01); *A47F 7/065* (2013.01); *A47G 25/10* (2013.01); *D06F 57/04* (2013.01); *F16M 11/08* (2013.01); *F16M 11/28* (2013.01)

(58) Field of Classification Search
CPC ..... A45D 44/14; A45D 44/00; A45D 44/02; A45D 44/04; A45D 44/10; A45D 8/00; A45D 2008/002; A45D 2008/004; A47F 7/06; A47F 5/04; A47F 7/065; A47F 5/05; A47F 5/106; A47F 5/0006; A47F 5/02; A47F 3/10; A47F 3/11; A42B 1/002; A47B 61/04; A47B 61/02; A47B 46/005; A47B 2063/005; A47B 49/00; A47B 49/008; A47G 25/00; A47G 25/10;A47G 25/06; A47G 25/0607; A47G 25/0685; A47G 25/0664; A47C 7/64; A47C 11/00; B60R 7/10; B65D 85/18; D06F 57/12; D06F 57/04; F16M 11/08; F16M 11/28
USPC ..... 211/33, 30, 31, 32, 99, 100, 197, 172, 211/85.24, 196, 205, 87.01, 175, 163, 211/165, 85.3; 223/66, 7, 120; D6/315, D6/328; 206/8, 9
See application file for complete search history.

(56) References Cited

U.S. PATENT DOCUMENTS

| | | | | | |
|---|---|---|---|---|---|
| 252,925 | A * | 1/1882 | Browning | A47F 7/06 | 211/33 |
| 366,316 | A * | 7/1887 | Haynes | A47F 7/06 | 211/33 |
| 393,873 | A * | 12/1888 | Wilson | A47F 7/06 | 211/33 |
| 421,879 | A * | 2/1890 | Wilson | A47F 7/06 | 211/181.1 |
| D30,771 | S | 5/1899 | Morrow | | |
| 808,528 | A * | 12/1905 | Finney et al. | A63B 69/208 | 211/33 |

(Continued)

*Primary Examiner* — Jennifer E Novosad

(57) ABSTRACT

The stand for supporting wigs is a device that is adapted to support a plurality of wigs thereon. The stand includes a base from which a plurality of support members extends telescopically. The plurality of support members extends vertically. Each of the plurality of support members includes an armature that extends laterally over to a wig holder. The wig holder is a hemispherically-shaped object that is adapted to receive a wig thereon. The wig holders are able to be raised and rotated to differing locales with respect to one another so as to not interfere with wigs being supported on the plurality of wig holders. The plurality of support members are able to rotate about a vertical axis so as to adjust the position of the armature and the wig holder with respect to one another.

10 Claims, 5 Drawing Sheets

(56) References Cited

U.S. PATENT DOCUMENTS 872,139 A * 11/1907 Mentzer ..... A47F 7/06 211/181.1
1,231,635 A * 7/1917 Nelson ..... A47F 7/06 211/173
1,387,765 A * 8/1921 Colonna ..... A47F 5/06 211/168
1,746,487 A * 2/1930 Martin ..... A47G 25/10 211/196
2,094,810 A * 10/1937 Oppenheimer ..... A47F 7/06 211/166
3,315,819 A * 4/1967 Kingsbery ..... A47F 5/04 211/163
3,465,926 A * 9/1969 Schwartz ..... A45D 44/14 206/8
3,515,318 A * 6/1970 Preble ..... A45D 44/14 206/8
3,658,283 A 4/1972 Martin
D225,752 S * 1/1973 Mencimer ..... D6/681.3
3,779,433 A * 12/1973 Imai ..... A45D 44/14 223/66
D230,777 S 3/1974 Imai
3,820,694 A * 6/1974 Pabis ..... A47F 5/04 211/13.1
3,847,285 A * 11/1974 Leprince ..... A47F 7/065 211/1.53
D245,131 S * 7/1977 Johnsson ..... D6/405
4,470,527 A * 9/1984 Middleton ..... F16B 7/10 223/66
5,449,073 A * 9/1995 DeBeverly ..... A47F 7/00 211/168
5,848,710 A * 12/1998 Pomper ..... A47F 7/024 211/205
6,012,591 A * 1/2000 Brandenberg ..... A47B 9/14 211/26
6,112,909 A * 9/2000 Moseley ..... A47F 5/0807 211/30
7,159,728 B2 * 1/2007 Smith ..... A45D 44/14 211/115
D538,064 S 3/2007 Schechter
D624,332 S * 9/2010 Nwatu ..... D20/32
D719,769 S * 12/2014 Daniels ..... D6/682.1
8,950,591 B1 * 2/2015 McDowell ..... A45D 44/14 211/13.1
2002/0125380 A1 * 9/2002 Brehmer ..... A47F 5/04 248/121
2010/0300900 A1 * 12/2010 Quan ..... A45C 11/16 206/6.1

* cited by examiner

STAND FOR SUPPORTING WIGS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of wigs, more specifically, a stand that supports a plurality of wigs thereon.

SUMMARY OF INVENTION

The stand for supporting wigs is a device that is adapted to support a plurality of wigs thereon. The stand includes a base from which a plurality of support members extends telescopically. The plurality of support members extends vertically. Each of the plurality of support members includes an armature that extends laterally over to a wig holder. The wig holder is a hemispherically-shaped object that is adapted to receive a wig thereon. The wig holders are able to be raised and rotated to differing locales with respect to one another so as to not interfere with wigs being supported on the plurality of wig holders. The plurality of support members are able to rotate about a vertical axis so as to adjust the position of the armature and the wig holder with respect to one another. The base is positioned atop of a stationary base member, which enables the base and the plurality of support members to rotate with respect to the stationary base member.

These together with additional objects, features and advantages of the stand for supporting wigs will be readily apparent to those of ordinary skill in the art upon reading the following detailed description of the presently preferred, but nonetheless illustrative, embodiments when taken in conjunction with the accompanying drawings.

In this respect, before explaining the current embodiments of the stand for supporting wigs in detail, it is to be understood that the stand for supporting wigs is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the stand for supporting wigs.

It is therefore important that the claims be regarded as including such equivalent construction insofar as they do not depart from the spirit and scope of the stand for supporting wigs. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
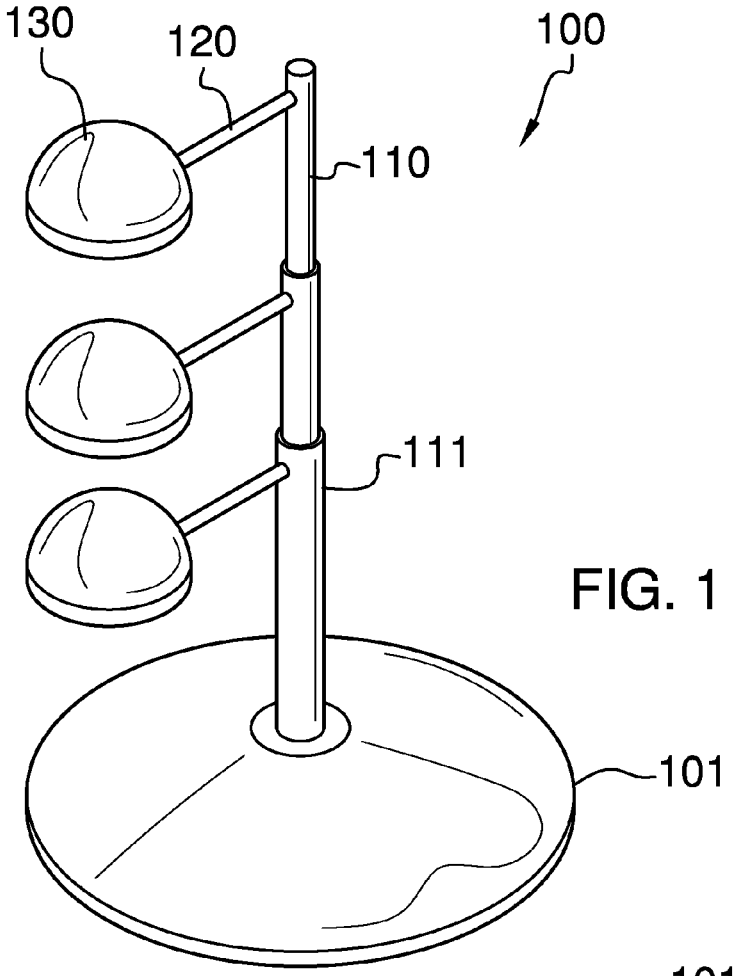
FIG. 1 is a perspective view of an embodiment of the disclosure.
Figure 2:
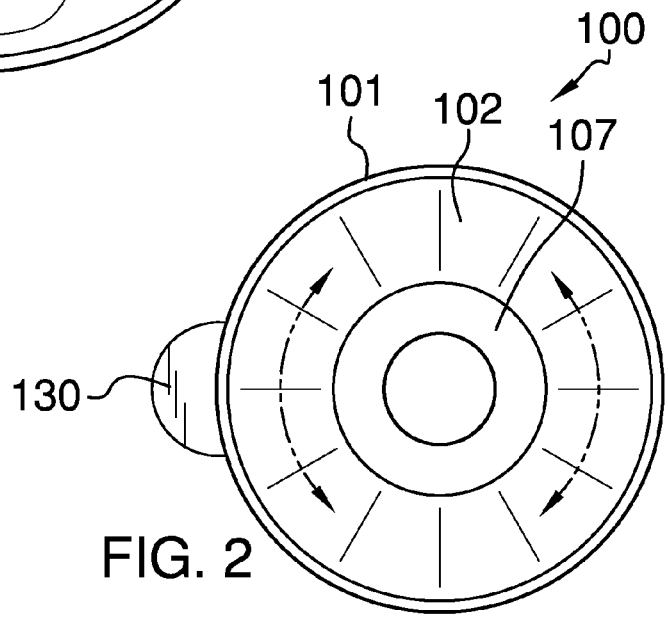
FIG. 2 is a top view of an embodiment of the disclosure.
Figure 3:
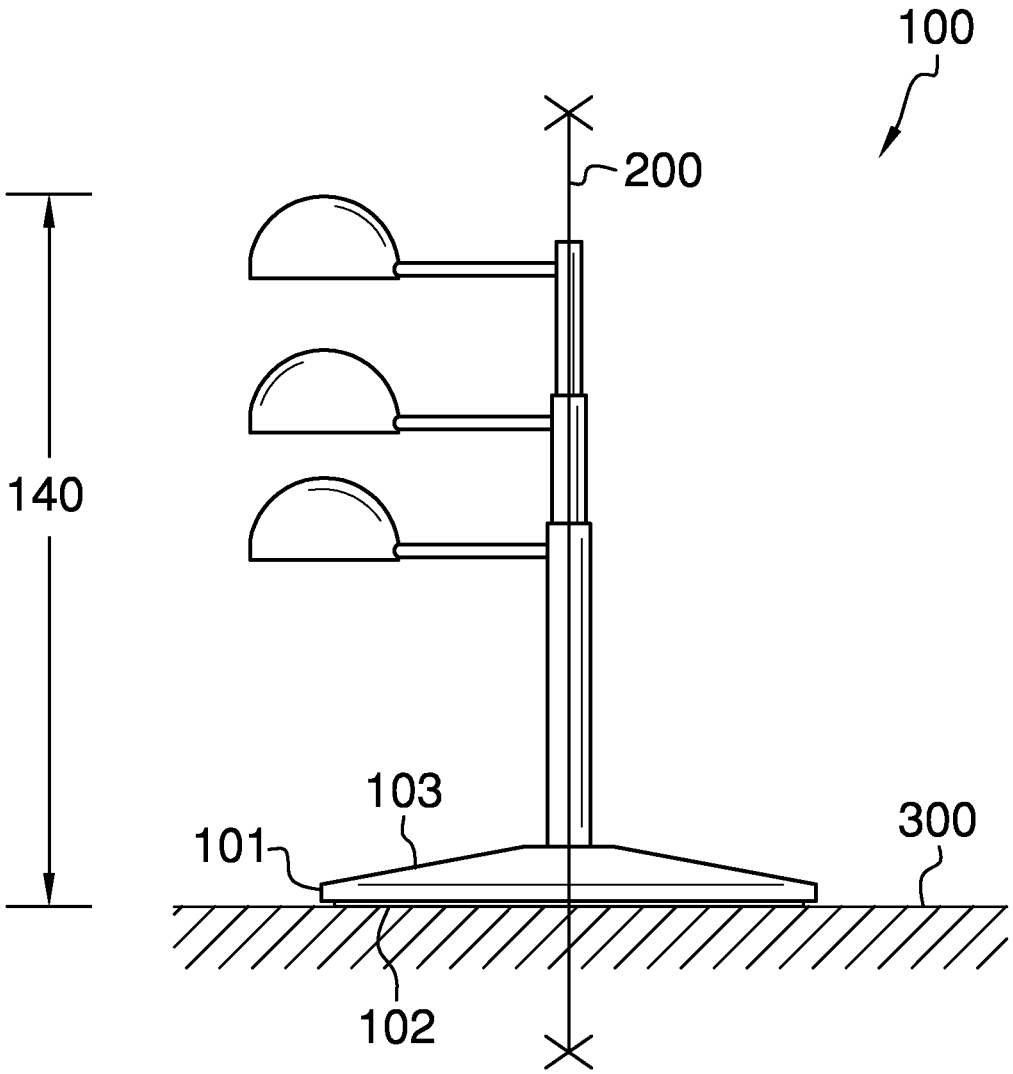
FIG. 3 is a side view of an embodiment of the disclosure.
Figure 4:
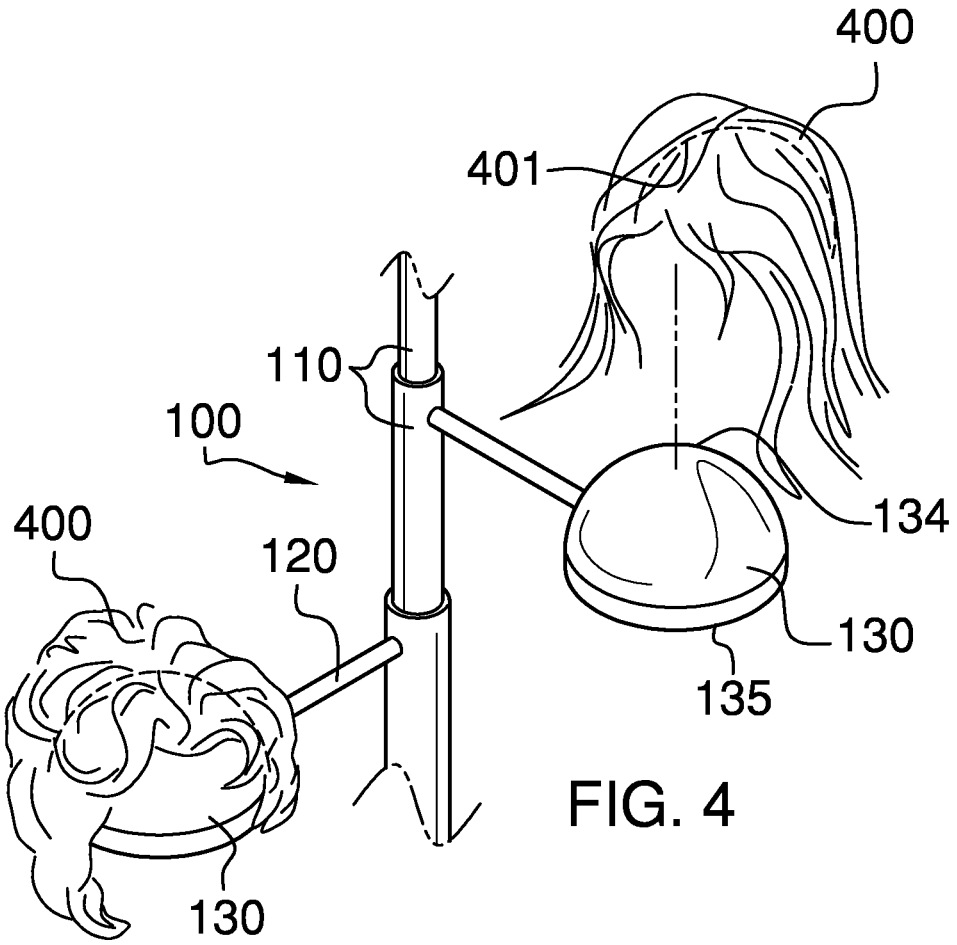
FIG. 4 is a detail view of an embodiment of the disclosure in use.

Detailed reference will now be made to a first potential embodiment of the disclosure, which is illustrated in FIGS. 1 through 6. The stand for supporting wigs 100 (hereinafter invention) comprises a base 101 that is seated atop of a stationary base member 102. The base 101 is able to rotate with respect to the stationary base member 102. Moreover, the base 101 rotates with respect to a vertical axis 200, and with respect to the stationary base member 102. Referring to FIG. 2, the arrows indicate rotational movement of the base 101 with respect to the stationary base member 102. The base 101 is rotatably affixed to the stationary base member 102 via a bearing 107.

The base 101 and the stationary base member 102 may be disc-shaped. The stationary base member 102 is adapted to rest on a ground surface 300. The base 101 is further defined with a top base surface 103. A plurality of support members 110 extend vertically with respect to the base 101. The plurality of support members 110 is further defined as including a bottommost support member 111. The bottommost support member 111 is affixed to the base 101. Moreover, the bottommost support member 111 is rotatably affixed to the top base surface 103 such that the bottommost support member 111 is able to rotate with respect to the vertical axis 200. The plurality of support members 110 are able to rotate with respect to the vertical axis 200.

The plurality of support members 110 are each further defined with an armature 120 that extends perpendicularly. The armature 120 extends perpendicularly with respect to the support members 110. Moreover, the armature 120 is further defined with a first distal end 121 that includes a wig holder 130 thereon. The wig holder 130 is further defined as a hemispherically-shaped portion 134, which is adapted to receive a wig 400 thereon. The wig holder 130 is further defined with a flat holder surface 135 that is positioned underneath the hemispherically-shaped portion 134. The hemispherically-shaped portion 134 is adapted to interface with an inner wig surface 401 of the wig 400. The wig holder 130 is located a wig distance 131 away from the plurality of support members 110. The wig distance 131 defines the length of the armature 120.

Figure 5:
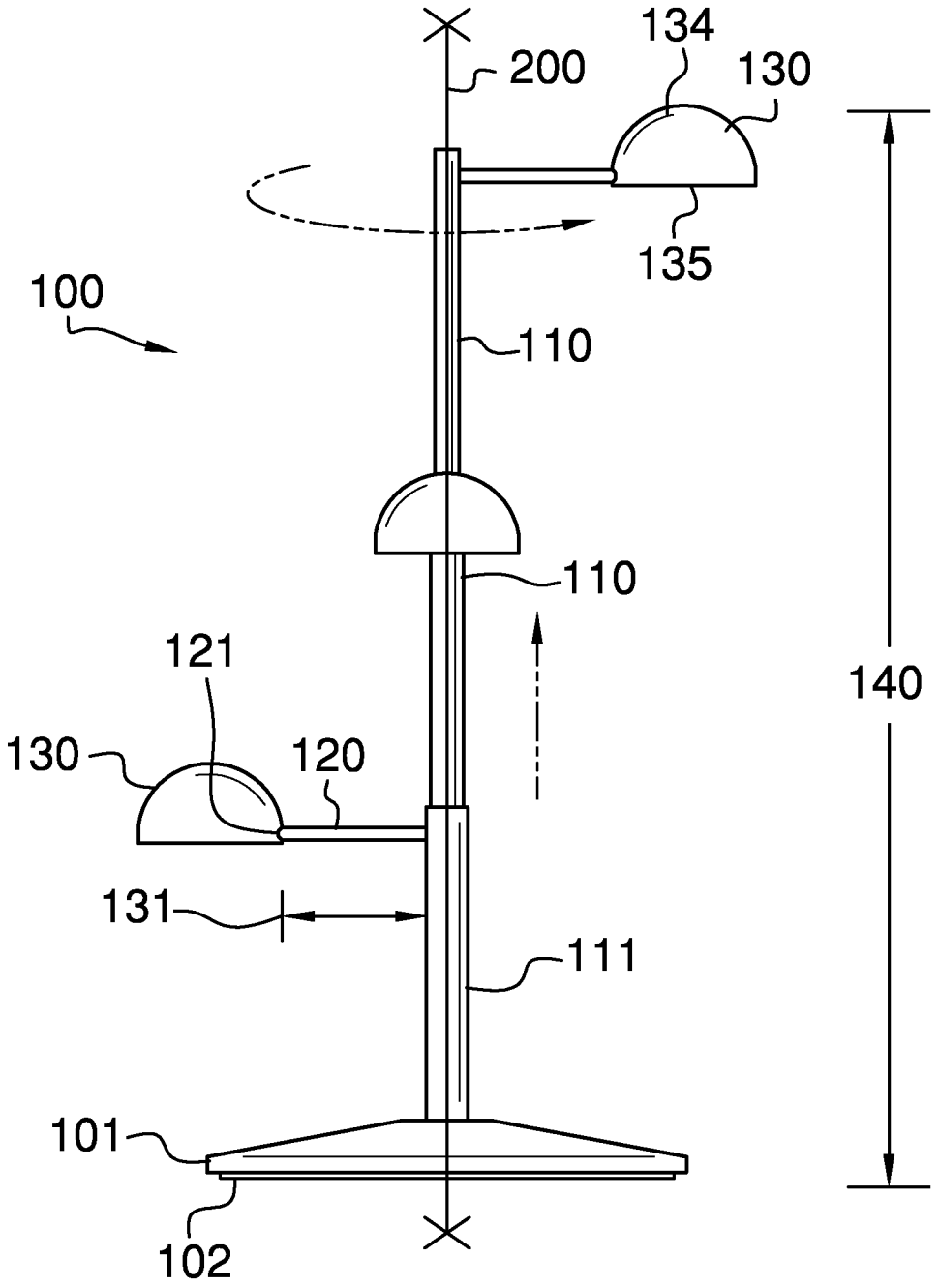
FIG. 5 is another side view of an embodiment of the disclosure.

The wig holder 130 of each of the plurality of support members 110 is able to be adjusted in terms of height and is able to be rotated about the vertical axis 200. Referring to FIG. 5, the wig holders 130 are able to be raised and lowered as well as rotated around the vertical axis 200 so as to provide clearance for differing wigs 400 that may be supported via the invention 100. Moreover, referring to FIG. 1, the wig holders 130 may be linearly aligned when not in use.

Figure 6:
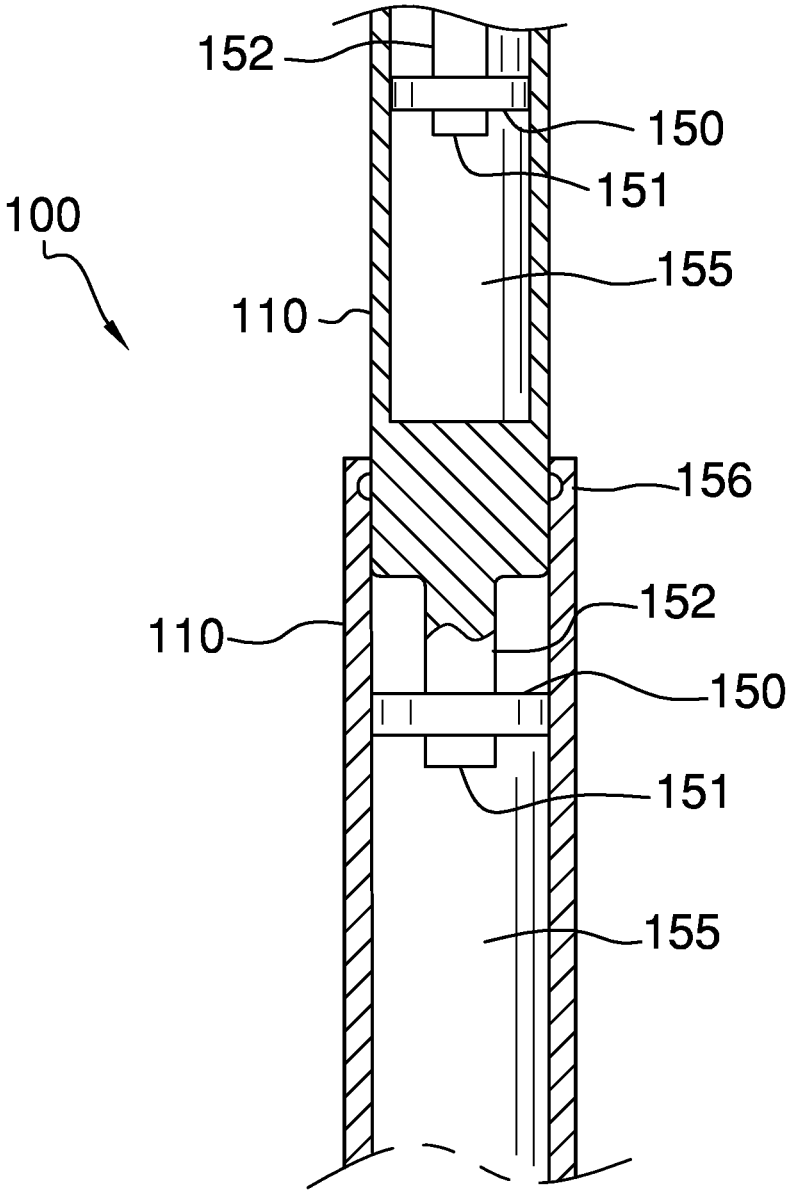
FIG. 6 is a detail view of an embodiment of the disclosure.

The plurality of support members 110 are in telescopic arrangement with one another. The plurality of support members 110 are able to extend and retract with one another in order to adjust an overall height 140 of the invention 100. Referring to FIG. 6, the plurality of support members 110 may each involve the use of a hydraulic shock that would enable the plurality of support members 110 to extend and retract with one another as well as stay at a particular position relative one another. The plurality of support members 110 each include a piston 150 that is affixed to a shaft distal end 151 of a hydraulic shaft 152 of each one of the plurality of support members 110. The hydraulic shaft 152 and the piston 150 are able to moved up and down within a cavity 155 provided on an adjacent one of the plurality of support members 110. A gasket 156 may be included to insure a watertight seal between adjacent support members 110. The use of the hydraulics in the plurality of support members 110 facilitates the rotation of the armatures 120 with respect to the vertical axis 200.

The plurality of support members 110 is ideally constructed of metal piping. The armatures 120 and the wig holders 130 may be made of a plurality of materials comprising plastic, wood, metal, carbon fiber composite, etc. The base 101 and the stationary base member 102 may be made of a plurality of materials comprising plastic, wood, metal, carbon fiber composite, etc.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A stand for supporting wigs comprising:

a base from which one of a plurality of support members extends;

wherein each of the plurality of support members includes a wig holder that is adapted to support a wig thereon such that the stand is able to support multiple wigs simultaneously;

wherein the base is seated atop of a stationary base member;

wherein the base is able to rotate with respect to the stationary base member; wherein the base rotates with respect to a vertical axis, and with respect to the stationary base member;

wherein the base is rotatably affixed to the stationary base member via a bearing;

wherein the base and the stationary base member are disc-shaped;

wherein the stationary base member is adapted to rest on a ground surface;

wherein the base is further defined with a top base surface;

wherein the plurality of support members extend vertically with respect to the base;

wherein the plurality of support members is further defined as including a bottommost support member;

wherein the bottommost support member is affixed to the base;

wherein the bottommost support member is rotatably affixed to the top base surface such that the bottommost support member is able to rotate with respect to the vertical axis; wherein the plurality of support members are able to rotate with respect to the vertical axis;

wherein the wig holder is further defined as a hemispherically-shaped portion, which is adapted to receive the wig thereon.

2. The stand for supporting wigs according to claim 1 wherein the plurality of support members are each further defined with an armature that extends perpendicularly from the respective support member.

3. The stand for supporting wigs according to claim 2 wherein the armature extends perpendicularly with respect to the support members.

4. The stand for supporting wigs according to claim 3 wherein the armature is further defined with a first distal end that includes the wig holder thereon.

5. The stand for supporting wigs according to claim 4 wherein the wig holder is further defined with a flat holder surface that is positioned underneath the hemispherically-shaped portion; wherein the hemispherically-shaped portion is adapted to interface with an inner wig surface of the wig.

6. The stand for supporting wigs according to claim 5 wherein the wig holder is located a wig distance away from the plurality of support members; wherein the wig distance defines the length of the armature.

7. The stand for supporting wigs according to claim 6 wherein the plurality of support members are in telescopic arrangement with one another; wherein the plurality of support members are able to extend and retract with one another in order to adjust an overall height.

8. The stand for supporting wigs according to claim 7 wherein the plurality of support members each include a piston that is affixed to a shaft distal end of a hydraulic shaft; wherein each one of the plurality of support members includes the piston and the hydraulic shaft.

9. The stand for supporting wigs according to claim 8 wherein the hydraulic shaft is further defined with a cavity; wherein the piston is able to be moved up and down within the cavity provided on the hydraulic shaft of an adjacent one of the plurality of support members.

10. The stand for supporting wigs according to claim 9 wherein a gasket is included to insure a watertight seal between adjacent support members.

* * * * *